United States Patent [19]

Forsyth

[11] Patent Number: 5,065,467

[45] Date of Patent: Nov. 19, 1991

[54] PREFABRICATED LATTICE PANELS FOR A BRIDGE

[75] Inventor: Richard C. E. Forsyth, Hook, England

[73] Assignee: Mabey & Johnson Limited, Reading, United Kingdom

[21] Appl. No.: 520,574

[22] Filed: May 8, 1990

[30] Foreign Application Priority Data

May 25, 1989 [GB] United Kingdom ..... 8911984

[51] Int. Cl.[5] ..... E01D 9/02

[52] U.S. Cl. ..... 14/13; 14/4

[58] Field of Search ..... 14/13, 3, 17, 4, 5, 14/6, 73

[56] References Cited

U.S. PATENT DOCUMENTS

| | | | |
|---|---|---|---|
| 15,048 | 6/1856 | Truesdell | 14/4 |
| 3,394,419 | 7/1968 | Sedlacek | 14/13 |
| 4,706,436 | 11/1987 | Mabey et al. | 14/4 X |

FOREIGN PATENT DOCUMENTS

| | | | |
|---|---|---|---|
| 1102675 | 10/1955 | France | 14/3 |
| 2019925 | 11/1979 | United Kingdom . | |
| 1597953 | 9/1981 | United Kingdom . | |

*Primary Examiner*—George A. Suchfield

*Attorney, Agent, or Firm*—Pennie & Edmonds

[57] ABSTRACT

A lattice panel (P1) for a bridge has only a single chord (C1), along one side (S1), with no chord along the opposite side (S2), resulting in a cost and weight saving when two such panels are stacked in one plane. A lattice (L) of web members (W) comprises: either n+1 perpendicular web members (Wp1-3) at n+1 "first" nodes (N1.1-N1.3) or n perpendicular web members (Wp1, Wp2) at all but an end one of n+1 "first" nodes (Wp1, Wp2); 2n "first" oblique web members (Wo1-Wo4) and 2n "second" web members (Wo5-Wo8) form two quadrilateral structures between the n+1 "first" nodes (Wp1, Wp2). Two "fourth" nodes (N4.1, N4.2) are formed by the tops of the quadrilateral structures, for connection to a second chord or to corresponding nodes of a like panel.

13 Claims, 3 Drawing Sheets

PREFABRICATED LATTICE PANELS FOR A BRIDGE

BACKGROUND TO THE INVENTION

This invention relates to prefabricated lattice panels for main girder-forming trusses in bridges of the type comprising two main girders at the sides of the bridge, each girder being single, double or triple-truss, each truss being single or double storey.

DESCRIPTION OF PRIOR ART

British patent specification No. 1 597 953 discloses and claims a prefabricated lattice bridge girder component having a single chord-forming member and a zig-zag shaped web formation with at least four legs and having its ends and one or alternate apex parts attached to the chord-forming member to form a lattice of two or more adjacent triangles having the chord-forming member as a common base, the ends of the chord-forming member and the remaining apex parts of the web formation remote from the chord-forming member having holes to enable two or more such components to be bolted or pinned end to end, or in reverse facing relationship with or without an intervening lattice frame.

This has not however been used in practice for bridges.

Bridges may have span:depth ratios sometimes as much as 25:1, so that panels 5 feet (1.524 m) may form single-storey single-truss girders for bridges spanning 125 feet (38.1 m), but lower span:depth ratios, such as 15:1 or even 10:1, provide stiffer bridges which suffer less deflection under load.

There is known (see FIGS. 1 and 2 of the drawings) a prefabricated unit panel of metal for a unit construction bridge, to extend upright along one side of the bridge, as a main girder truss-forming panel, comprising a formation of web members welded to two chord members to form a lattice having at least one quadrilateral, the or each said quadrilateral being welded at opposite corners of the or each said quadrilateral to the two chord members. A plurality of the web members each extend perpendicularly to the chords and are welded to the chords and to intermediate corners of the quadrilateral or quadrilaterals. Two of said web members each extend perpendicularly to the chords and are welded to the chords and to respective intermediate corners of the quadrilateral, or of respective quadrilaterals, at respective ends of the panel.

The chords and shear members may be of various strengths from panel to panel to cater for different bending and shear strengths in different bridges or even in the same bridge.

This prefabricated unit panel (FIGS. 1 and 2) could be described in other terms as comprising:

- a chord extending longitudinally of the panel along at least one side of the panel, with a respective connection fitment at each end of the chord; and
- a lattice of web members welded to the chord so as to extend from the chord to an opposite side of the panel;

said lattice of web members comprising:

- a number n+1 of "perpendicular" web members extending perpendicularly to the chord and having "first" ends welded to the chord at n+1 spaced-apart "first" nodes along the chord;
- an even number 2n of "first" obliquely-disposed web members in n pairs, each said pair of first obliquely-disposed web members being disposed between a respective two of said perpendicular web members, each said pair of first obliquely-disposed web members having two "first" ends thereof welded together and to the chord at a respective one of n "second" nodes, each said second node being between a respective two of said first nodes, and each said pair of first obliquely-disposed web members having two "second" ends thereof welded respectively to the two perpendicular web members, forming n+1 "third" nodes, said third nodes being intermediate the two sides of the panel;
- 2n "second" obliquely-disposed web members in n pairs, each said pair of second obliquely-disposed web members being disposed between a respective two of said perpendicular web members, each said pair of second obliquely-disposed web members having two "first" ends thereof welded respectively at said third nodes to said second ends of the corresponding pair of said first obliquely-disposed web members and to the corresponding two perpendicular web members and each said pair of second obliquely-disposed web members having two "second" ends thereof welded together at a respective one of n "fourth" nodes at the opposite side of the panel;
- and n connection fitments provided respectively at said n fourth nodes at the opposite side of the panel.

More particularly, the known lattice panel referred to above has a second chord along said opposite side of the panel, the perpendicular web members extending across to the opposite side of the panel and being welded to the second chord.

The known lattice panel is designed to be used in conjunction with other similar, or identical, lattice panels, bolted together end-to-end at the chords, to form trusses for the main girders of a lattice bridge, with one or more deck-supporting transoms extending across the bridge between the girders. The quadrilaterals have their sides respectively either in compression or tension, depending upon the positions of the individual quadrilaterals in the bridge. That is to say, each quadrilateral will most likely have two sides in compression (acting as struts) and two sides in tension (acting as ties). The shorter the strut-forming sides, the less likely they are to buckle.

The perpendicular web members serve to support the chords against secondary loads, for example when the bridge is being launched on rollers across the space to be bridged. They may also transmit transom loads and shear forces into the quadrilateral lattice.

FIG. 1 of the drawings shows such a known lattice panel P, comprising two chords C1, C2, each extending longitudinally of the panel P along a respective one of two opposite sides S1, S2 of the panel P, with four connection fitments F1 to F4, one at each end of each chord C1, C2.

A lattice L of web members W is welded to the chords C1, C2 so as to extend from the chord C1 on one said side S1 to the chord C2 on the opposite side S2 of the panel P.

The lattice L of web members W comprises a number n+1 (three, i.e. n=2) of "perpendicular" web members Wp1, Wp2, Wp3 extending perpendicularly to the chords C1, C2 and having opposite ends welded to the respective chords at n+1 spaced-apart "first" nodes N1.1, N1.2, N1.3 along each chord C1, C2. Nodes N1.1 and N1.3 are at opposite ends of the respective chord C1 or C2, whilst node N1.2 is halfway along the chord.

The lattice L also comprises an even number 2n (i.e. four) of "first" obliquely-disposed web members Wo1 to Wo4 in n (two) pairs.

One pair of said first obliquely-disposed web members Wo1, Wo2 are disposed between a respective two of said perpendicular web members Wp1, Wp2. Web members Wo1, Wo2 have their two "first" ends welded together and to one said chord C1 at a respective "second" node N2.1, halfway between first nodes N1.1, N1.2. Web members Wo1, Wo2 have their two "second" ends welded respectively to intermediate points on the two perpendicular web members Wp1, Wp2, forming "third" nodes N3.1, N3.2.

The other pair of said first obliquely-disposed web members Wo3, Wo4 are disposed between another respective two of said perpendicular web members Wp2, Wp3. Web members Wo3, Wo4 have their two "first" ends welded together and to one said chord C1 at a respective "second" node N2.2, halfway between first nodes N1.2, N1.3. Web members Wo3, Wo4 have their two "second" ends welded respectively to intermediate points on the two perpendicular web members Wp2, Wp3, one at the second "third" node N3.2 and the other at a third "third" node N3.2.

The lattice L also comprises an even number 2n (i.e. four) of "second" obliquely-disposed web members Wo5 to Wo8 in n (two) pairs. Each said pair of second obliquely-disposed web members Wo5, Wo6 or Wo7, Wo8 firstly have their two "first" ends welded respectively at said third nodes N3.1, N3.2 or N3.2, N3.3 to said second ends of a corresponding pair of said first obliquely-disposed web members Wo1, Wo2 or Wo3, Wo4 and to the intermediate points on the corresponding two perpendicular web members and secondly have their two "second" ends welded together at a respective one of n "fourth" nodes N4.1 and N4.2 along the other said chord C2.

The four obliquely-disposed web members Wo1, Wo2, Wo5 and Wo6 form the four respective sides of a first quadrilateral Q1, whilst the other four obliquely-disposed web members Wo3, Wo4, Wo7 and Wo8 form the four respective sides of a second quadrilateral Q2. The nodes N2.1, N3.1 N3.2 and N4.1 form the four corners of first quadrilateral Q1, whilst the nodes N2.2, N3.2, N3.3 and N4.2 form the four corners of second quadrilateral Q2.

It is furthermore known to "stack" two such panels together in one plane to make a composite "two-storey" panel having one chord of one panel lying adjacent one chord of the other panel and having the other chords of the two panels spaced apart by said one chords, and by the lattices of web members, of the two panels. FIG. 2 shows two panels P in accordance with FIG. 1 stacked together in this way.

Such a composite panel has increased bending strength due to the greater spacing apart of the chords C1, C1 on the outsides of the composite panel. However, the two mutually adjacent chords C1, C2 contribute almost nothing to the bending strength of the composite panel because they are on a centre-line of the composite panel. Hence, given that all four chords are quite expensive and heavy components of the composite panel, but only two of the chords are contributing to bending strength, such an arrangement is wastefully expensive and heavy. Furthermore, the adjacent chords of the two panels have to be closely enough toleranced, dimensionally, to be joined together.

SUMMARY OF THE INVENTION

The invention provides a lattice panel as claimed in each of the claims, to which reference is directed.

DESCRIPTION OF PREFERRED EMBODIMENTS

Figure 3:
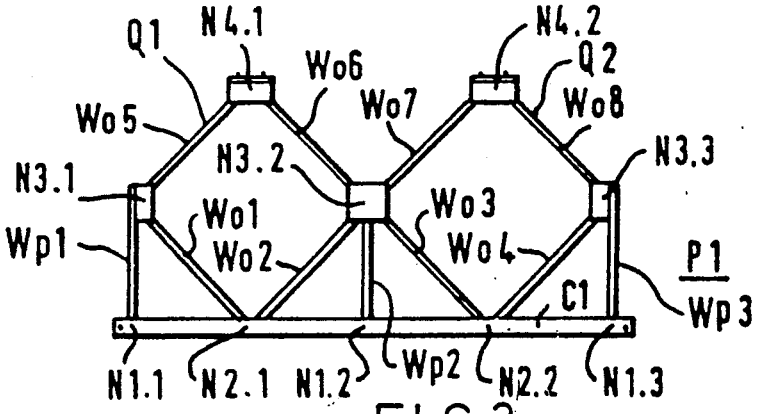
FIG. 3 illustrates a first panel embodying the invention.

Referring to FIG. 3, there is shown a first type of lattice panel P1 embodying the invention. This first embodiment of lattice panel P1 comprises, like the panel P of FIG. 1:

a chord C1 extending longitudinally of the panel P along a first side of S1 of two opposite sides S1, S2 of the panel P, with two connection fitments F1, F2, one at each end of chord C1.

A lattice L of web members W is welded to the chord C1 so as to extend from the chord C1 on one said side S1 to the opposite side S2 of the panel P.

The lattice L of web members W comprises a number n+1 (three, i.e. n=2) of "perpendicular" web members Wp1, Wp2, Wp3 extending perpendicularly to the chords C1, C2 and having opposite ends welded to the respective chords at n+1 spaced-apart "first" nodes N1.1, N1.2, N1.3 along each chord C1, C2.

The lattice L also comprises an even number 2n (i.e. four) of "first" obliquely-disposed web members Wo1 to Wo4 in n (two) pairs.

One pair of said first obliquely-disposed web members Wo1, Wo2 are disposed between a respective two of said perpendicular web members Wp1, Wp2. Web members Wo1, Wo2 have their two "first" ends welded together and to chord C1 at a respective "second" node N2.1, halfway between first nodes N1.1, N1.2. Web members Wo1, Wo2 have their two "second" ends welded respectively to intermediate points on the two perpendicular web members Wp1, Wp2, forming "third" nodes N3.1, N3.2.

The other pair of said first obliquely-disposed web members Wo3, Wo4 are disposed between another respective two of said perpendicular web members Wp2, Wp3. Web members Wo3, Wo4 have their two "first" ends welded together and to chord C1 at a respective "second" node N2.2, halfway between first nodes N1.2, N1.3. Web members Wo3, Wo4 have their two "second" ends welded respectively to intermediate points on the two perpendicular web members Wp2, Wp3, one at the second "third" node N3.2 and the other at a third "third" node N3.2.

The lattice L also comprises an even number 2n (i.e. four) of "second" obliquely-disposed web members Wo5 to Wo8 in n (two) pairs. Each said pair of second obliquely-disposed web members Wo5, Wo6 or Wo7, Wo8 firstly have their two "first" ends welded respectively at said third nodes N3.1, N3.2 or N3.2, N3.3 to said second ends of a corresponding pair of said first obliquely-disposed web members Wo1, Wo2 or Wo3, Wo4 and to the second ends of the corresponding pair of perpendicular web members and secondly have their two "second" ends welded together, and to a respective connection fitment, at a respective one of 2n "fourth" nodes N4.1 and N4.2 at the other side S2 of the panel P1.

Figure 1:
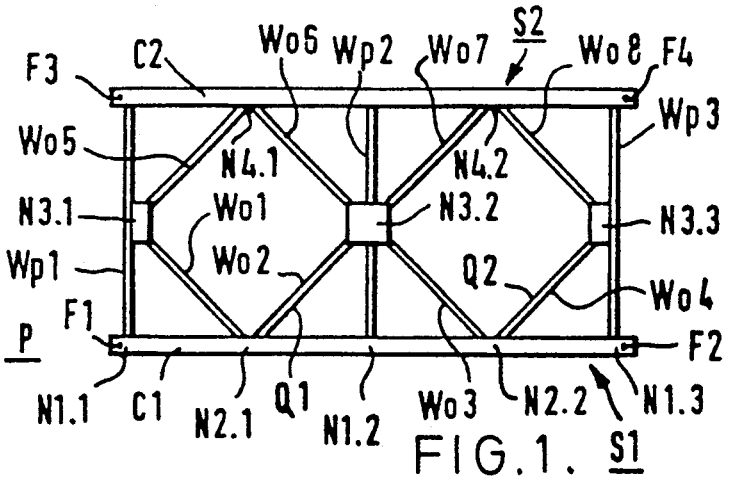
FIG. 1 illustrates a known lattice panel for a main girder truss in a lattice panel bridge.

Unlike the known panel P of FIG. 1, the panel P1 of FIG. 3 has no second chord (corresponding to chord C2) at the second side S2. Furthermore, the perpendicular web members Wp1, Wp2 and Wp3 terminate at the third nodes N3.1, N3.2 and N3.3, instead of extending across to the second side S2.

The four obliquely-disposed web members Wo1, Wo2, Wo5 and Wo6 form the four respective sides of a first quadrilateral Q1, whilst the other four obliquely-disposed web members Wo3, Wo4, Wo7 and Wo8 form the four respective sides of a second quadrilateral Q2. The nodes N2.1, N3.1, N3.2 and N4.1 form the four corners of first quadrilateral Q1, whilst the nodes N2.2, N3.2, N3.3 and N4.2 form the four corners of second quadrilateral Q2.

Besides the two connection fitments at nodes 4.1 and 4.2, there are shear force-transmitting connection fitments at nodes N1.1, N1.3, N3.1 and N3.3.

Like panel P, panel P1 is prefabricated. A second chord (not shown, but like chord C2 of FIG. 1) may be bolted on site to the two nodes N4.1 and N4.2 if desired.

Figure 2:
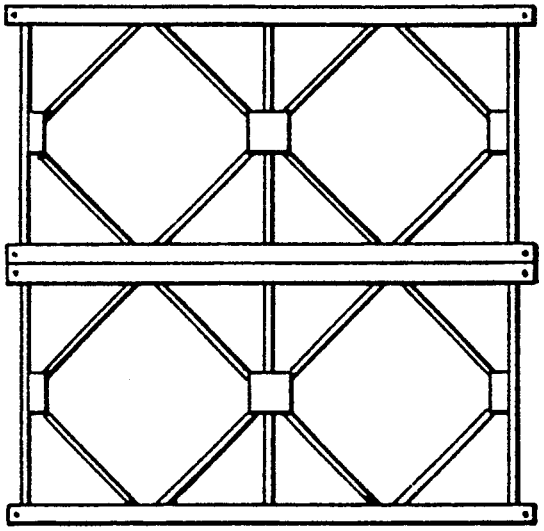
FIG. 2 illustrates a stack of two such known panels.
Figure 4:
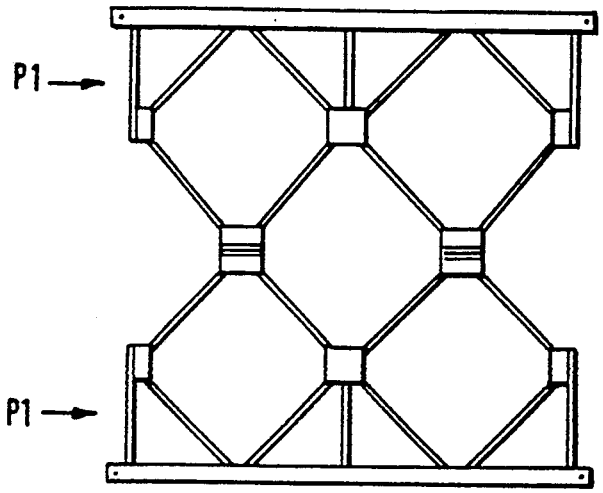
FIG. 4 a stack of two such panels embodying the invention.

When two panels P1 are "stacked" (in two storeys) as shown in FIG. 4—compare with FIG.2—there are no chords where the "fourth" nodes N4.1 and N4.2 of the two panels P1 are bolted together by the connection fitments provided there. This results in a substantial saving in cost and approximately 30% saving in weight without adversely affecting the combined bending strength of the two stacked panels P1 (compared with the combined bending strength of the two panels P of FIG. 2). Furthermore, the only positional tolerances which matter are those of the connection fitments at nodes N4.1 and N4.2 of the two panels.

Figure 5:
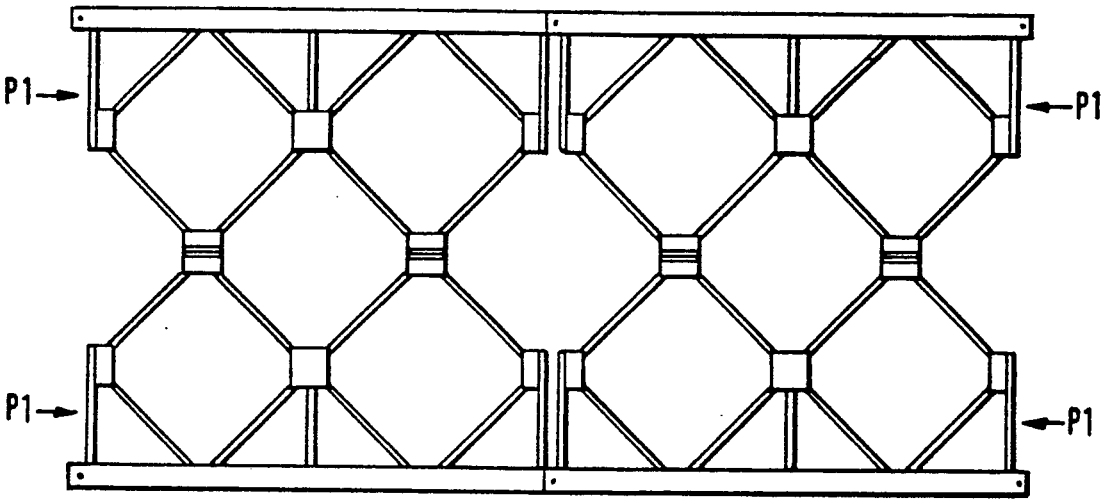
FIG. 5 illustrates a truss of four such panels embodying the invention.

When a two-storey truss is made up of four panels P1 as shown in FIG. 5, there are two pairs of mutually adjacent perpendicular web members Wp1, Wp3. In this configuration, one, end, perpendicular web member Wp3 of each pair Wp1, Wp3 is superfluous. Hence, in the panel P2 of FIGS. 6 to 8, the third perpendicular web member Wp3 of FIGS. 3 to 5 is omitted, so that there are only n perpendicular web members.

Figure 6:
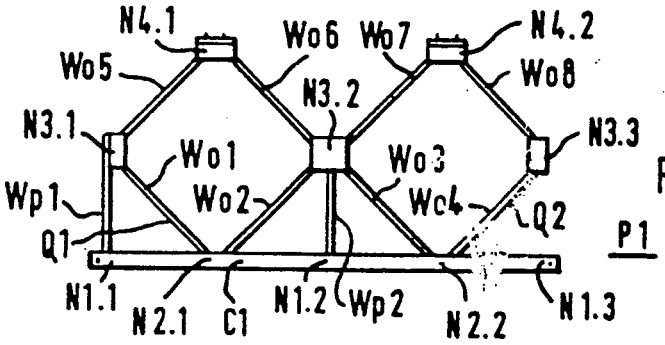
FIG. 6 illustrates a modified panel embodying the invention.
Figure 7:
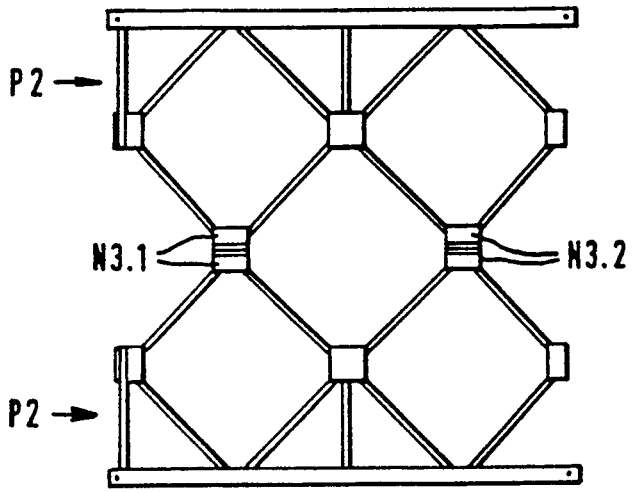
FIG. 7 illustrates a "stack" of two of these modified panels.
Figure 8:
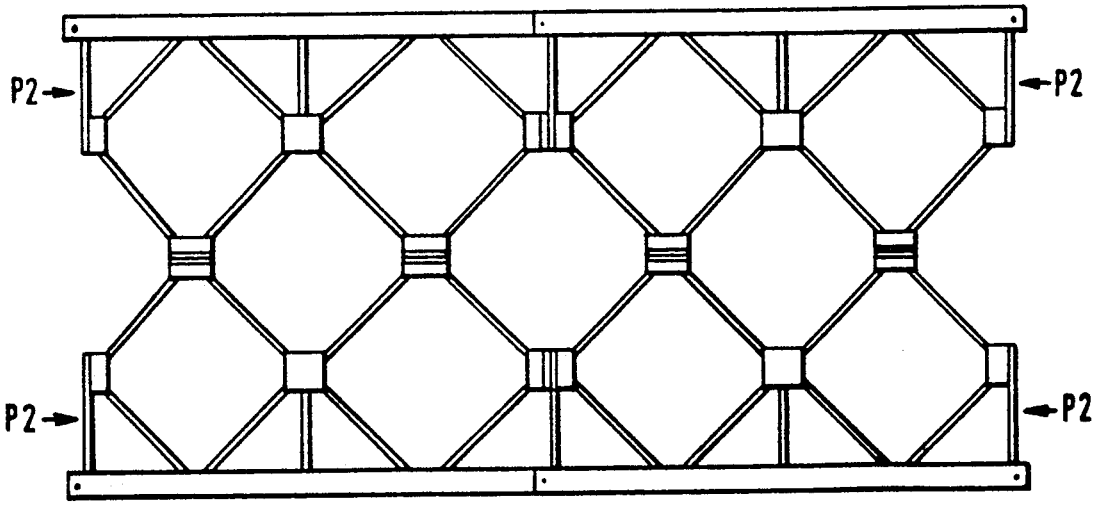
FIG. 8 illustrates a truss of four of these modified panels.

Given that panels P1, P2 (like panel P) are prefabricated, it will be realised that panel P2 of FIGS. 6 to 8 is cheaper and lighter in weight in the four-panel truss configuration of FIG. 8 than panel P1 (compare FIG. 5) but may require the addition of the missing third perpendicular web member Wp3 in the stacked two-panel configuration of FIG.7 (compare FIG. 4).

In a modification, n is 1, 3 or 4, instead of 2. For example, if n=3, there would be one more perpendicular web member, one more pair each of first oblique members and second oblique members and one more each of first, second, third and fourth nodes respectively, with a third quadrilateral structure formed thereby.

I claim:

1. A lattice panel for use in a main girder truss of a lattice panel bridge, comprising:

a chord extending longitudinally of the panel along one side of the panel, with a respective connection fitment at each end of the chord; and a lattice of web members welded to the chord so as to extend from the chord to an opposite side of the panel;

the panel having no corresponding chord at said opposite side of the panel;

said lattice of web members comprising:

a number n+1 of "perpendicular" web members extending perpendicularly to the chord and having "first" ends welded to the chord at n+1 spaced-apart "first" nodes along the chord;

an even number 2n of "first" obliquely-disposed web members in n pairs, each said pair of first obliquely-disposed web members being disposed between a respective two of said perpendicular web members and having their two "first" ends welded to the chord at a respective on of n "second" nodes and their two "second" ends welded respectively to "second" ends of the two respective perpendicular web members, forming n+1 "third" nodes;

2n "second" obliquely-disposed web members in n pairs, each said pair of second obliquely-disposed web members having their two "first" ends welded respectively at said third nodes to said second ends of a corresponding pair of said first obliquely-disposed web members and to said second ends of the corresponding two perpendicular web members and having their two "second" ends welded together at a respective one of n "fourth" nodes;

and n shear force-transmitting connection fitments provided respectively at said n fourth nodes.

2. Two substantially identical lattice panels, each as claimed in claim 1, connected together in one plane at their said fourth nodes by means of said fitments at said fourth nodes and having their respective chords mutually spaced apart by said web members.

3. A lattice panel for use in a main girder truss of a lattice panel bridge, comprising:

a chord extending longitudinally of the panel along one side of the panel, with a respective shear force-transmitting connection fitment at each end of the chord; and a lattice of web members welded to the chord so as to extend from the chord to an opposite side of the panel;

the panel having no corresponding chord at said opposite side of the panel;

said lattice of web members comprising:

a number n of "perpendicular" web members extending perpendicularly to the chord and having "first" ends welded to the chord at all but an end one of n+1 spaced-apart "first" nodes along the chord;

an even number 2n of "first" obliquely-disposed web members in n pairs, each said pair of first obliquely-disposed web members being disposed between a respective pair of said first nodes and having their two "first" ends welded to the chord at a respective one of n "second" nodes and, except in the case of an end one of said first obliquely-disposed web members, having their two "second" ends welded respectively to "second" ends of the two perpendicular web members, forming n "third" nodes; a further third node being formed by the second end of said end one of said first obliquely-disposed web members, at the same end of the lattice panel as said end one of said first nodes;

2n "second" obliquely-disposed web members in n pairs, each said pair of second obliquely-disposed web members having their two "first" ends welded respectively at said third nodes to said second ends of a corresponding pair of said first obliquely-disposed web members and, except in the case of an end one of said second obliquely-disposed web members, to said second ends of the corresponding two perpendicular web members and having their two "second" ends welded together at a respective one of n "fourth" nodes;

and n shear force-transmitting connection fitments provided respectively at said n fourth nodes.

4. A lattice panel as claimed in claim 1 or 3, wherein n is 2.

5. A lattice panel as claimed in claim 1 or 3, wherein each said obliquely-disposed web member is at an angle of 45°±2° to the chord.

6. A lattice panel as claimed in claim 1 or 3, wherein each said obliquely-disposed web member is at an angle of 55°±2° to the chord.

7. A lattice panel as claimed in claim 1 or 3, wherein two end ones of said third nodes are provided respectively with shear force-transmitting connection fitments.

8. A prefabricated lattice panel for a main girder truss in a lattice panel bridge, to extend upright along one side of the bridge, comprising a formation of web members welded to a single chord member to form a lattice having at least one quadrilateral, the or each said quadrilateral being welded at a single corner of the or each said quadrilateral to the single chord member, an opposite corner of the or each said quadrilateral having a shear force-transmitting connection fitment for connection of the panel in the bridge, an intermediate corner of the quadrilateral, or of one said quadrilateral, being positioned at one end of the panel and having a fitment for making a shear force-transmitting connection of the panel in the bridge.

9. A panel as claimed in claim 8 having two said quadrilaterals, intermediate corners of which are welded together.

10. A panel as claimed in claim 8, wherein at least one of said web members extends perpendicularly to the chord and is welded to the chord and to an intermediate corner of said quadrilateral, or of at least one said quadrilateral.

11. A panel as claimed in claim 10, wherein a plurality of said web members each extends perpendicularly to the chord and is welded to the chord and to an intermediate corner of the quadrilateral, or of at least one said quadrilateral.

12. A panel as claimed in claim 10 or 11, wherein one of said web members extends perpendicularly to the chord and is welded to the chord and to the intermediate corner of the quadrilateral at said one end of the panel.

13. A panel as claimed in claim 10 or 11, wherein none of said web members extends perpendicularly to the chord nor is welded to the chord and to the intermediate corner of the quadrilateral at said one end of the panel.

* * * * *